US005787781A

United States Patent [19]

Hile

[11] Patent Number: 5,787,781

[45] Date of Patent: Aug. 4, 1998

[54] SHINGLE CUTTER

[76] Inventor: Robert Lee Hile, 75 Ash Rd., Uniontown, Pa. 15401

[21] Appl. No.: 912,320

[22] Filed: Aug. 18, 1997

[51] Int. Cl.[6] ..... B26D 5/08; B26D 7/01

[52] U.S. Cl. ..... 83/467.1; 83/468.1; 83/607; 83/DIG. 1

[58] Field of Search ..... 83/467.1, 468.1, 83/607, 608, 609, 468, 564, DIG. 1

[56] References Cited

U.S. PATENT DOCUMENTS

| | | | |
|---|---|---|---|
| 1,212,118 | 1/1917 | Schutz | 83/607 |
| 1,730,718 | 10/1929 | Bosch, Jr. | 83/607 X |
| 2,779,409 | 1/1957 | Becker | 83/608 X |
| 3,089,373 | 5/1963 | Fischer et al. | 83/607 X |
| 3,224,314 | 12/1965 | Wolnez | 83/609 X |
| 3,735,445 | 5/1973 | Jurcak | 83/607 X |
| 3,811,355 | 5/1974 | Cole | 83/607 X |
| 4,951,540 | 8/1990 | Cross et al. | 83/607 X |
| 4,957,235 | 9/1990 | Beno et al. | 83/607 X |
| 5,052,256 | 10/1991 | Morrissey | 83/607 X |
| 5,249,495 | 10/1993 | Renk | 83/607 X |

*Primary Examiner*—Eugenia Jones
*Attorney, Agent, or Firm*—Aileen Champion Addessi

[57] ABSTRACT

A shingle cutter for cutting a substantially straight even edge on a shingle includes a base with a work surface for supporting the shingle during cutting. A blade with a substantially straight cutting edge and a handle is pivotally attached to the base. The pivotal attachment includes a bearing and a lock nut disposed on a threaded rod or pivot arm, which keeps the blade tight against a support member recessed in the base. A guide member having a raised edge is positioned on the work surface of the base for aligning the shingle to be cut. The blade and the support member are formed of an angled piece of material for providing additional strength while cutting through the thickness of the shingle. The base is attached to legs for elevating the base above a supporting surface. A pad, which may be formed of a non-skid material, is attached to the legs for preventing the shingle cutter from sliding down the roof. A safety mechanism is provided for preventing movement of the blade during non-use of the shingle cutter.

19 Claims, 3 Drawing Sheets

SHINGLE CUTTER

BACKGROUND OF THE INVENTION

The invention relates to an apparatus for cutting through objects and, more particularly, to an apparatus for cutting shingles.

To install a roof on a house requires cutting numerous shingles for laying the shingles along the edges of the roof, along adjoining angled roof sections, around roof fixtures, etc. Currently, the shingles are cut freehand such as with a utility knife or tin snips sometimes making an uneven or jagged edge along the cut edge of the shingle. The different thickness of shingles require different exertions of force to cut through the shingle making the cutting a tedious and time consuming process.

Therefore, what is needed is an apparatus for cutting shingles which substantially cuts a straight edge along the shingle and has a leveraged handle for easily cutting through the shingles.

SUMMARY OF THE INVENTION

A shingle cutter includes a base having a work surface, and a support member attached to the work surface at an edge of the base. A blade is pivotally attached to the base adjacent to the support member and has a cutting edge and a handle. A bearing is coupled to the blade and a tightening mechanism is positioned adjacent to the bearing for securely holding the blade against the support member for enabling a sufficient amount of pressure to be exerted onto an object for enabling the blade to cut through the object.

Additionally, the shingle cutter further includes a guide member having a raised edge attached to the base and positioned substantially perpendicular to the blade for aligning the object along the raised edge of the guide member. A pair of legs are attached to the base for elevating the base above a supporting surface and extend beyond the base for providing support while cutting the object. A pad is attached to the legs for restricting movement of the shingle cutter with respect to the support surface.

The handle of the blade extends beyond the base for providing leverage to cut through the object. The blade is formed of an angled piece of material and has a substantially straight cutting edge. The support member is formed of an angled piece of material.

The pivotal attachment of the blade to the base includes a bracket attached to the support member and a pivot arm inserted through a hole of the blade and attached to the bracket. The bearing is disposed on the pivot arm, and the tightening mechanism is adjustably secured to the pivot arm for altering positioning of the blade with respect to the support member.

A safety mechanism of the shingle cutter includes the blade having a bore therethrough, the bracket having a bore therethrough, and a pin disposable within the bore of the blade and within the bore of the bracket for preventing movement of the blade. A stop is positioned at the edge of the base for restricting pivotal movement of the blade.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

Figure 1:
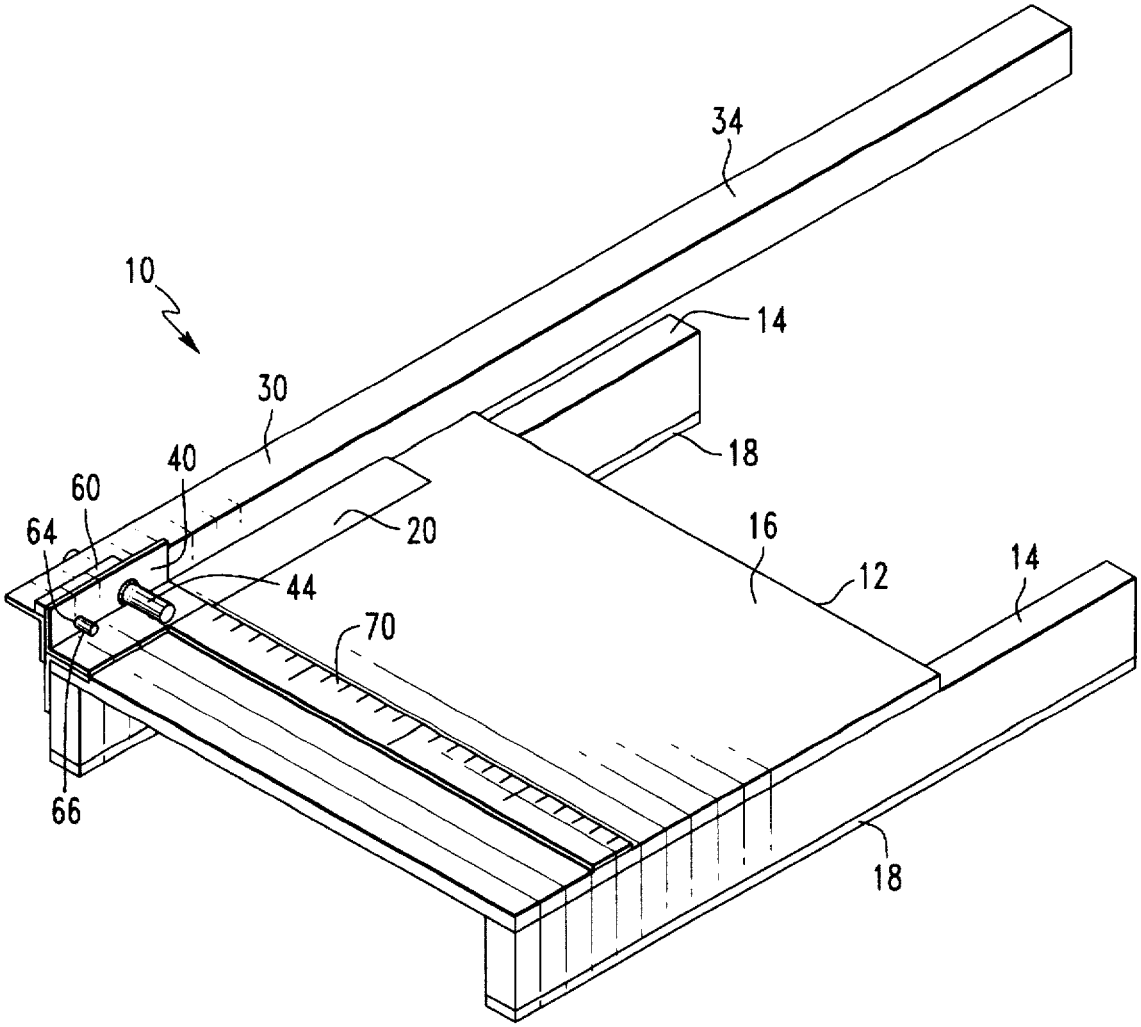
FIG. 1 is a schematic illustration of a shingle cutter in a closed position.
Figure 2:
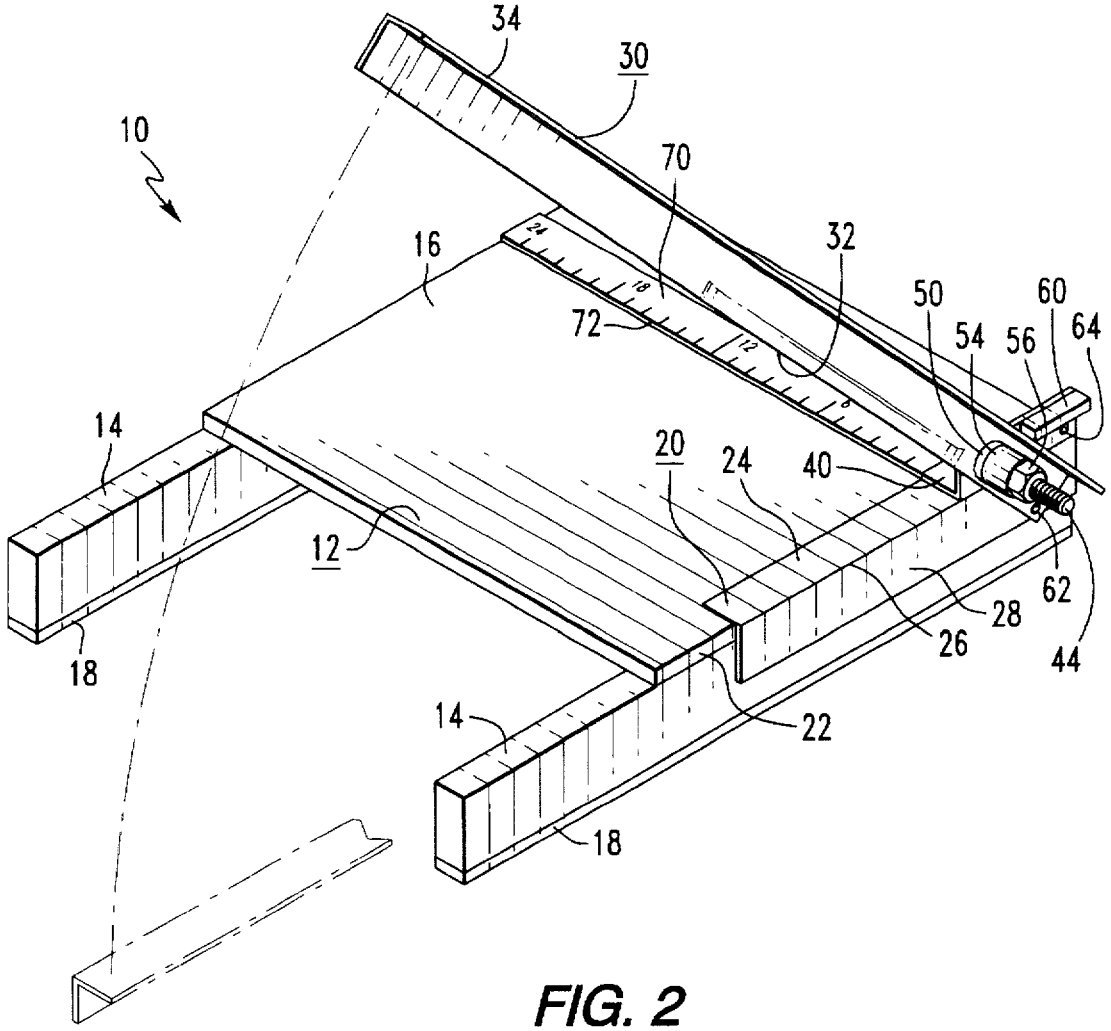
FIG. 2 is a schematic illustration of the shingle cutter in an open position.
Figure 3:
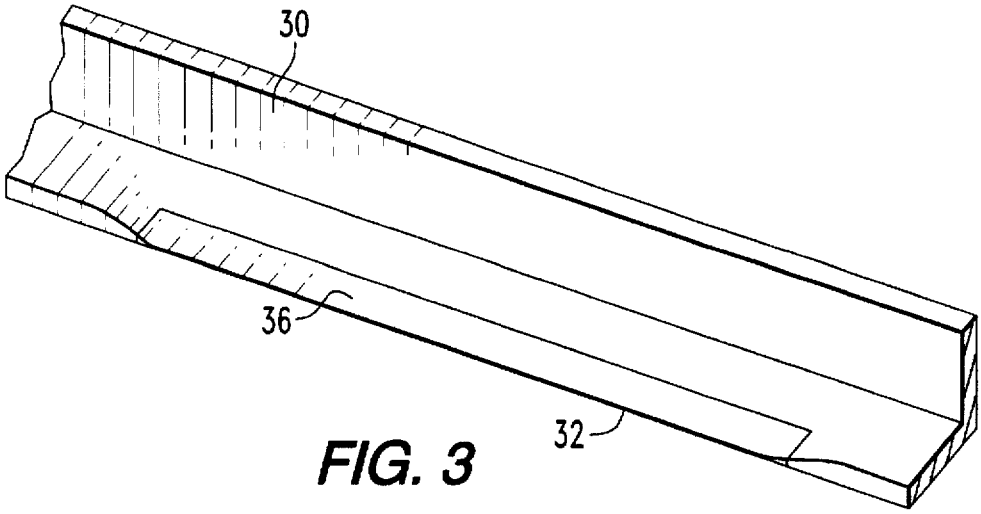
FIG. 3 is a partial view of a blade of the shingle cutter.
Figure 4:
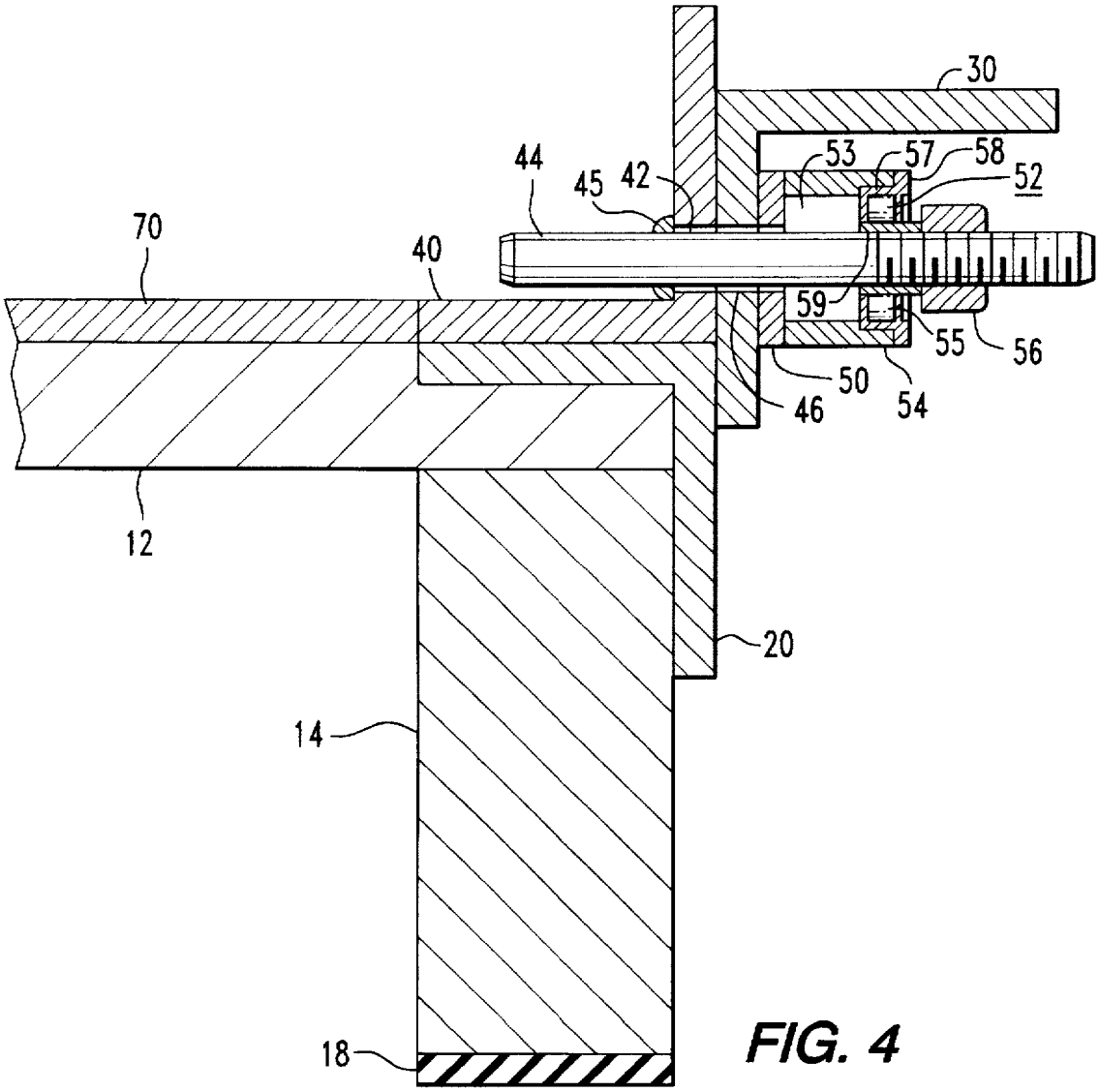
FIG. 4 is a partial cross-sectional view of the shingle cutter.

Referring to FIGS. 1–4, a shingle cutter 10 includes a base 12 which may be formed of wood, aluminum or other lightweight material. A pair of legs 14 may be attached to the base 12 or integrally formed therewith for elevating the base 12 above a supporting surface, such as a roof or the ground. The legs 14 may be formed of wood, aluminum, or other suitable material. The legs 14 extend beyond a work surface 16 of the base 12 for providing support and stabilization during cutting. As an example, the legs 14 may extend approximately 10 inches from an edge of the work surface 16 of the base 12.

A pad 18, such as rubber, foam, or other non-skid material, is attached to the bottom of each leg 14 for providing resistance between the shingle cutter 10 and the supporting surface for substantially preventing movement of the shingle cutter 10, for example, slippage of the shingle cutter 10 down a roof The pad 18 may also be an absorbent material for protecting the roof during cutting of a shingle.

A support member 20 is attached to an edge 22 of the base 12 and is, preferably, formed of an angled piece of material. A first portion or top surface 24 of the angled material is embedded or recessed into the base 12 enabling a shingle to lay flat across the base 12 and the support member 20. The support member 20 also includes an edge 26 and a second portion 28, which extend from the top surface 24 around the edge 22 of the base 12 and downwardly along the leg 14. The edge 26 of the support member 20 is positioned adjacent to the edge 22 of the base 12. By using an angle piece of material, such as angle iron, steel or the like, the strength of the support member 20 is increased as compared to a non-angled piece of material positioned only on the top of the base 12.

A blade 30 is pivotally attached to the base 12 and is, preferably, formed of an angled piece of material, such as stainless steel, cold rolled steel or the like. In a closed position of the blade 30, the angled material has a first or top portion extending substantially parallel to the work surface 16 of the base 12, a second or side portion extending substantially perpendicular to the work surface 16 and positioned adjacent to the second portion 28 of the support member 20, and an edge therebetween.

The blade 30 has a cutting edge 32 and a handle 34. The cutting edge 32 of the blade 30 is substantially straight for providing a substantially even cut through the shingle. By using an angled piece of material, the strength of the blade 30 is increased and reduces bowing of the blade 30 during cutting of the shingle. The handle 34 extends beyond the base 12 and beyond the legs 14 for providing sufficient leverage to apply force to cut through one or more shingles. As an example, the work surface 16 may be approximately 30 inches long and the blade 30 may be approximately 50 inches long, making the work surface 16 of the base 12 approximately ⅗ as long as the blade. As another example, the blade 30 may be approximately twice as long as the base 12. The handle 34 may be rubber coated for the comfort of the user.

A carbide insert 36 may be attached to the cutting edge 32 of the blade 30 for providing a harder material to cut the shingles and increasing the life of the blade 30.

The pivotal attachment of the blade 30 and the base 12 includes a bracket 40 attached to the support member 20 and having a hole 42 therethrough for insertion of a pivot arm, such as a partially threaded rod 44. One end of the rod 44 extends through the hole 42 and is attached to the bracket 40, such as by weld 45, and the threaded end of the rod 44 extends through a hole 46 in the blade 30. A washer 50 is disposed on the threaded rod 44 adjacent to the blade 30. A bearing 52 encased by a bushing 54 is disposed on the threaded rod 44 between the washer 50 and a tightening mechanism 56. The washer 50 may be welded to the bushing 54. The tightening mechanism 56, such as a lock nut or the like, provides resistance to the blade 30 maintaining the blade 30 tight against the support member 20. By keeping the blade 30 tight against the support member 20, more pressure can be exerted onto the object being cut.

The bearing 52 is positioned within a counterbore of the bushing 54 and includes an outer race or housing 57 having a flange 58 which abuts an open end of the bushing 54 and extends beyond the end of the bushing 54. The bearing 52 has an inner race 59 which is longer than the bearing housing 57 and extends beyond the housing 57. The lock nut 56 contacts the inner race 59. Rollers 55, ball bearings, or the like are positioned within the bearing housing 57. A space 53 is provided between the bearing 52 and the washer 50.

The bearing 52, bushing 54 and lock nut 56 are removable, enabling the blade 30 to be removed. By being able to remove the blade 30, the cutting edge 32 can be easily re-sharpened.

A stop 60, which may be a rectangular metal bar, is attached to the bracket 40 and restricts the movement of the blade 30. The blade 30 contacts a bottom surface of the stop 60 which restricts downward rotation of the blade 30, and contacts an end of the stop 60 which restricts upward rotation of the blade 30.

A safety mechanism may be added to the shingle cutter 10 for preventing opening of the blade 30 during non-use or transportation of the shingle cutter 10. The safety mechanism includes a bore 62 through the blade 30 and a bore 64 through the bracket 50. A pin 66, such as a snap ring, may be inserted through the aligned bores 62 and 64 of the blade 30 and bracket 50, respectively, when it is desired to prevent movement of the blade 30.

A guide member 70 is attached to the work surface 16 of the base 12 and has a raised edge 72. Numerical and tick markings are included on the guide member 70 for measuring the shingles prior to cutting.

In operation, the handle 34 is raised above the base 12. After the shingle is measured, the shingle (not shown) is positioned on the work surface 16 of the base 12 and is aligned with the guide member 70 against the raised edge 72 for performing a straight cut perpendicular to the edge of the shingle aligned with the raised edge 72. The shingle is extended beyond the edge of the support member 20 by the amount to be cut from the shingle. The handle 34 is forcefully lowered to cut through the shingle or shingles, which are supported by the support member 20.

To cut a shingle to fit an angled portion of the roof, the shingle is not aligned with the guide member 70. After the shingle is measured and marked, the marks are aligned with the edge 26 of the support member 20 and the handle 32 is lowered for cutting through the shingle with the cutting edge 32 of the blade 30.

If tar builds up on the cutting edge 32 of the blade 30, as may occur in hot weather, oil may be put on the cutting edge 32 for making it easier to cut through the shingle.

An advantage of the shingle cutter 10 is that objects, such as shingles, having various degrees of thickness can be easily and smoothly cut without bending of the edges of the object and with minimal exertion of force. The shingle cutter 10 provides an even straight cut without jagged or irregular edges, providing a roof with a professional appearance. Use of the shingle cutter 10 reduces the amount of time required to cut the shingles, thereby reducing the overall time required to install the shingles on the roof.

Thus there has been shown and described a novel shingle cutter which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A shingle cutter, comprising:

a base having a work surface with an edge;

a support member attached to said work surface at said edge of said base;

a blade pivotally attached to said base adjacent to said support member having a cutting edge and a handle;

a bushing coupled to said blade and having an open end;

a bearing coupled to said blade and including an outer race positioned within said bushing and having a flange abutting said open end of said bushing, said bearing having an inner race disposed within said outer race and extending beyond said flange of said outer race; and a tightening mechanism positioned adjacent to and contacting said inner race of said bearing for securely holding said blade against said support member for enabling a sufficient amount of pressure to be exerted onto an object for enabling said blade to cut through said object.

2. The shingle cutter according to claim 1, wherein said cutting edge of said blade is substantially straight.

3. The shingle cutter according to claim 1, wherein said work surface of said base is approximately ⅗ as long as said blade enabling said handle of said blade to extend beyond said base for providing leverage to cut through said object.

4. The shingle cutter according to claim 1, wherein said blade is formed of an angled piece of material.

5. The shingle cutter according to claim 1, wherein said support member is formed of an angled piece of material.

6. The shingle cutter according to claim 1, further comprising a pair of legs attached to said base for elevating said base above a supporting surface and extending beyond said base for providing support while cutting said object.

7. The shingle cutter according to claim 6, further comprising a pad attached to said legs for restricting movement of said shingle cutter.

8. The shingle cutter according to claim 1, further comprising;

said blade having a hole therethrough;

a bracket attached to said support member;

a pivot arm inserted through said hole of said blade and attached to said bracket;

said bearing disposed on said pivot arm; and said tightening mechanism adjustably secured to said pivot arm for altering positioning of said blade with respect to said support member.

9. The shingle cutter according to claim 8, further comprising:

said blade having a bore therethrough;

said bracket having a bore therethrough; and a pin disposable within said bore of said blade and within said bore of said bracket for preventing movement of said blade.

10. The shingle cutter according to claim 1, further comprising a stop positioned at said edge of said base for restricting pivotal movement of said blade.

11. A shingle cutter, comprising:

a base having a work surface and a recess positioned at an edge of said work surface;

a support member formed of an angled piece of material, having a first portion, a second portion, and an edge therebetween, said first portion positioned within said recess on said work surface of said base, said edge of said support member positioned aligned with said edge of said base, and said second portion of said angled piece of material extending downwardly along said recessed edge of said base;

a bracket attached to at least one of said base and said support member;

a blade, formed of an angled piece of material, having a first portion, a second portion, and an edge therebetween, said second portion positioned adjacent to said second portion of said support member and having a hole therethrough and a cutting edge, and said blade having a handle;

a pivot arm disposed through said hole of said blade and attached to said bracket for pivotally attaching said blade to said base;

a bushing disposed on said pivot arm and having an open end;

a bearing, disposed on said pivot arm, including an outer race positioned within said bushing and having a flange abutting said open end of said bushing, and an inner race disposed within said outer race and extending beyond said flange of said outer race;

a tightening mechanism disposed on said pivot arm, positioned adjacent to said bearing, and contacting said inner race for enabling a sufficient amount of pressure to be exerted onto an object for enabling said blade to cut through said object;

a guide member attached to said work surface of said base and positioned substantially perpendicular to said blade for aligning said object along said guide member;

a stop attached to said bracket for restricting movement of said blade; and a pad attached to said base for resting on a support surface.

12. The shingle cutter according to claim 11, wherein said cutting edge of said blade is substantially straight.

13. The shingle cutter according to claim 11, wherein said handle of said blade extends beyond said base for providing leverage to cut through said object.

14. The shingle cutter according to claim 11, further comprising:

said base having a pair of legs for elevating said base above said support surface and extending beyond said work surface of said base for providing support during a cutting process; and said pad attached to said pair of legs for restricting movement of said shingle cutter.

15. The shingle cutter according to claim 11, wherein said tightening mechanism is a lock nut adjustably secured to said pivot arm for altering positioning of said blade with respect to said support member.

16. The shingle cutter according to claim 11, further comprising a safety mechanism attached to said blade, including:

said blade having a bore therethrough;

said bracket having a bore therethrough; and a pin disposable within said bore of said blade and within said bore of said bracket for preventing movement of said blade.

17. A shingle cutter, comprising:

a base having a work surface for positioning of a shingle;

a blade pivotally attached to said base having a substantially straight cutting edge and a handle;

a bushing coupled to said blade and having an open end;

a bearing coupled to said blade and including an outer race positioned within said bushing and having a flange abutting said open end of said bushing, said bearing having an inner race disposed within said outer race and extending beyond said flange of said outer race; and a tightening mechanism positioned adjacent to and contacting said inner race of said bearing for enabling a sufficient amount of pressure to be exerted onto said shingle for enabling said blade to cut through said shingle.

18. The shingle cutter according to claim 17, wherein said handle extends beyond said work surface of said base for providing leverage during cutting of said shingle.

19. The shingle cutter according to claim 17, wherein said blade is formed of an angled piece of material for providing strength to said blade during cutting of said shingle.

* * * * *